US006280163B1

(12) United States Patent
Chou

(10) Patent No.: US 6,280,163 B1
(45) Date of Patent: Aug. 28, 2001

(54) SPRING BLADE INTAKE VALVE FOR AIR COMPRESSOR

(76) Inventor: Wen San Chou, No. 15, Lane 833, Wen Hsien Road, Tainan 704 (TW)

( * ) Notice: Subject to any disclaimer, the term of this patent is extended or adjusted under 35 U.S.C. 154(b) by 0 days.

(21) Appl. No.: 09/460,289

(22) Filed: Dec. 11, 1999

Related U.S. Application Data

(63) Continuation-in-part of application No. 09/049,904, filed on Mar. 30, 1998, now Pat. No. 6,095,758.

(51) Int. Cl.[7] ..... F04B 17/00; F04B 39/10; F01B 9/00; F16H 1/12

(52) U.S. Cl. ..... 417/550; 417/360; 417/553; 92/140; 74/421 A; 74/421 R

(58) Field of Search ..... 417/550, 553, 417/545, 551, 423.14, 423.6, 360; 92/140; 74/421 A, 421 R

(56) References Cited

U.S. PATENT DOCUMENTS

| | | | | |
|---|---|---|---|---|
| 1,416,696 | * | 5/1922 | Dennedy | 417/550 |
| 1,628,096 | * | 5/1927 | Worth | 417/458 |
| 2,792,790 | * | 5/1957 | Capps | 103/173 |
| 3,961,868 | * | 6/1976 | Droege, Sr. et al. | 417/550 |
| 4,090,410 | * | 5/1978 | Nakamura | 74/414 |
| 5,215,447 | * | 6/1993 | Wen | 417/415 |
| 5,655,887 | * | 8/1997 | Chou | 417/63 |

* cited by examiner

*Primary Examiner*—Timothy S. Thorpe
*Assistant Examiner*—Timothy P. Solak

(57) ABSTRACT

An air compressor includes a piston slidably received in a housing, and a sealing ring engaged between the piston and the housing. The piston includes an aperture for air to flow into the housing. A spring blade has one end secured to the piston and the other end for resiliently blocking the aperture of the piston to form a check valve. A gear and a weight are secured to a base which is secured to the housing. The weight has an eccentric pin coupled to the piston. A motor has a pinion engaged with the gear for rotating the gear to move the piston up and down.

1 Claim, 5 Drawing Sheets

SPRING BLADE INTAKE VALVE FOR AIR COMPRESSOR

The present invention is a continuation-in-part of U.S. patent application Ser. No. 09/049,904, filed on Mar. 30, 1998, Now U.S. Pat. No. 6,095,758, Aug. 1, 2000.

BACKGROUND OF THE INVENTION

1. Field of the Invention

The present invention relates to an air compressor, and more particularly to an air compressor having an increased operation effect.

2. Description of the Prior Art

Typical air compressors comprise a piston including a large amount of elements and members required to be manufactured and assembled together, such that the cost for the air compressors is greatly increased.

The present invention has arisen to mitigate and/or obviate the afore-described disadvantages of the conventional air compressors.

SUMMARY OF THE INVENTION

The primary objective of the present invention is to provide an air compressor including a simplified piston for allowing the piston to be easily manufactured and assembled.

In accordance with one aspect of the invention, there is provided an air compressor comprising a housing including a tube extended upward therefrom, and including a passage formed therein and communicating the housing with the tube, the housing including a chamber formed therein, the tube including a pipe extended outward therefrom, a pressure gage connected to the pipe, a check valve received in the tube for controlling an air flow passage from the housing to the pipe, a piston slidably received in the chamber of the housing, the piston including an outer peripheral portion having an annular groove formed therein, the piston including a rod extended downward therefrom, the piston including an aperture formed therein for allowing air to flow into the housing via the aperture of the piston, means for resiliently blocking the aperture of the piston, the blocking means including a spring blade having a first end secured to the piston and having a second end resiliently blocking the aperture of the piston, a sealing ring received in the annular groove of the piston for making an air tight seal between the piston and the housing, a base secured to the housing, and means for forcing the piston to move along the chamber of the housing in a reciprocating action, the forcing means including a motor secured to the base and having a pinion provided thereon, a gear rotatably secured to the base at a pivot shaft and engaged with the pinion and driven by the motor via the pinion, the gear including a first half having a plurality of first teeth and including a second half having a plurality of second teeth, the first teeth including a size greater than that of the second teeth, the gear including a casing provided thereon, and a weight received in the casing and secured to the pivot shaft and rotated in concert with the gear, the weight including a pin extended therefrom and eccentric relative to the pivot shaft, the pin being coupled to the rod for coupling the piston to the weight and the gear.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
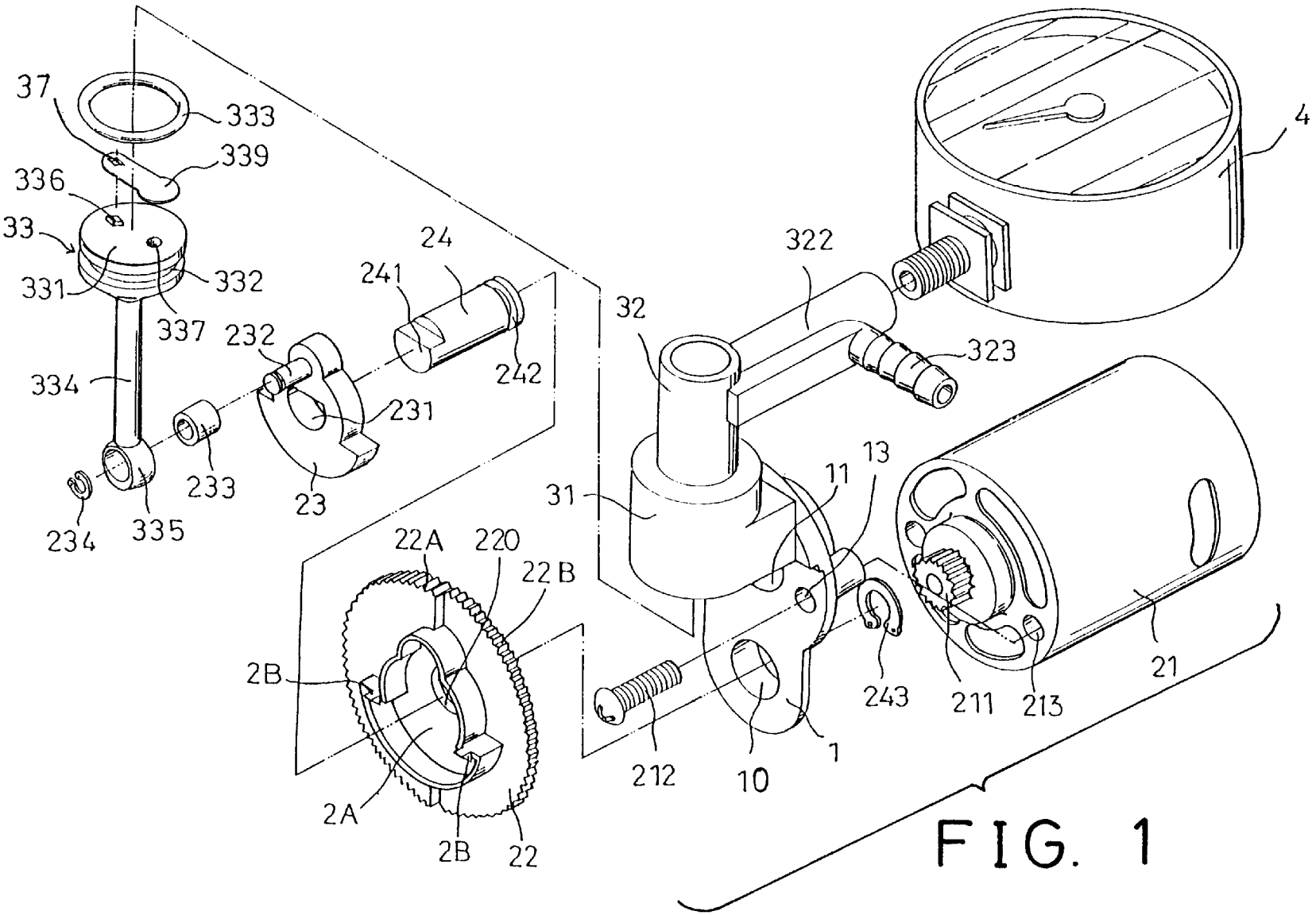
FIG. 1 is an exploded view of an air compressor in accordance with the present invention.
Figure 2:
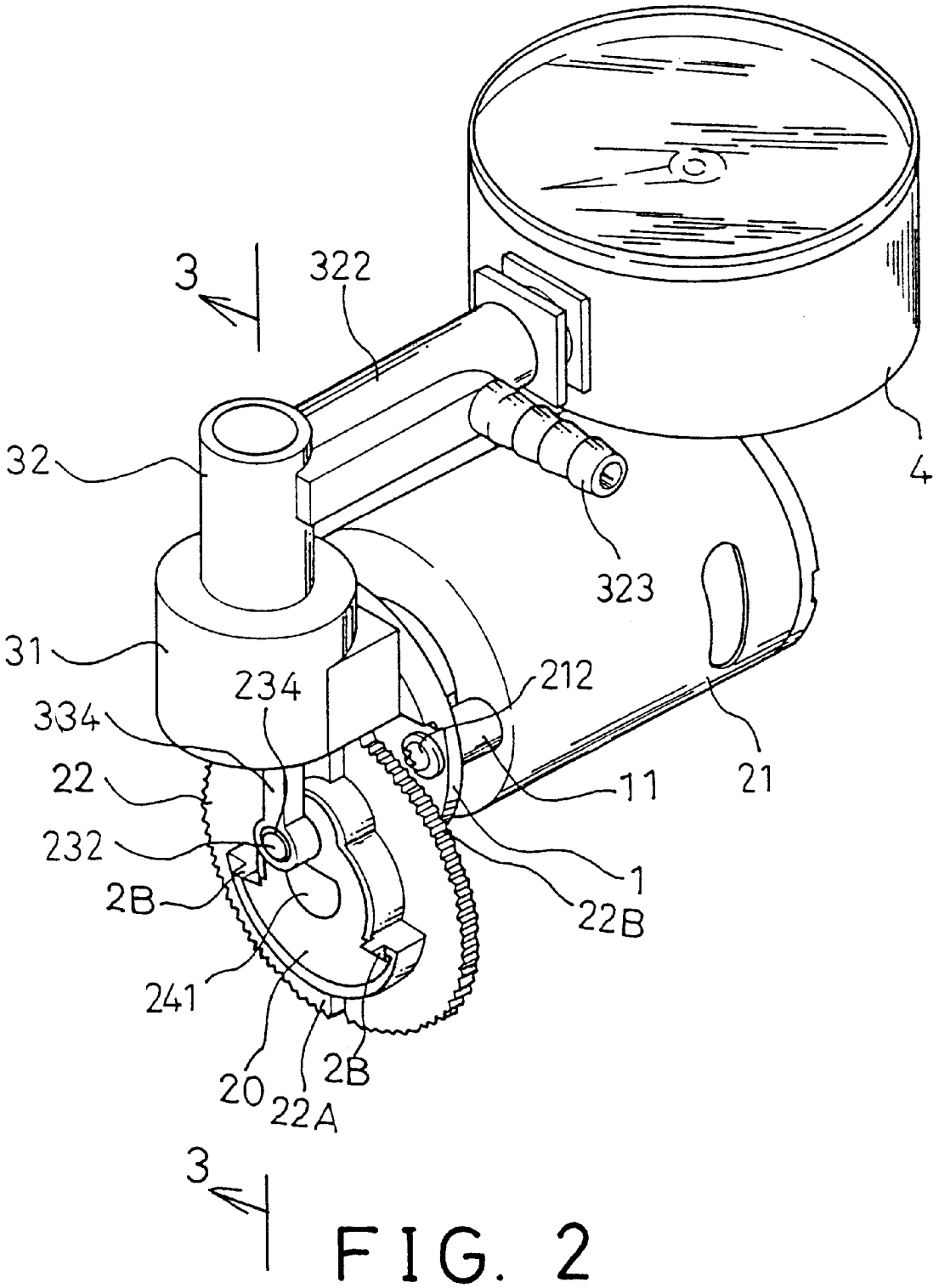
FIG. 2 is a perspective view of the compressor.
Figure 3:
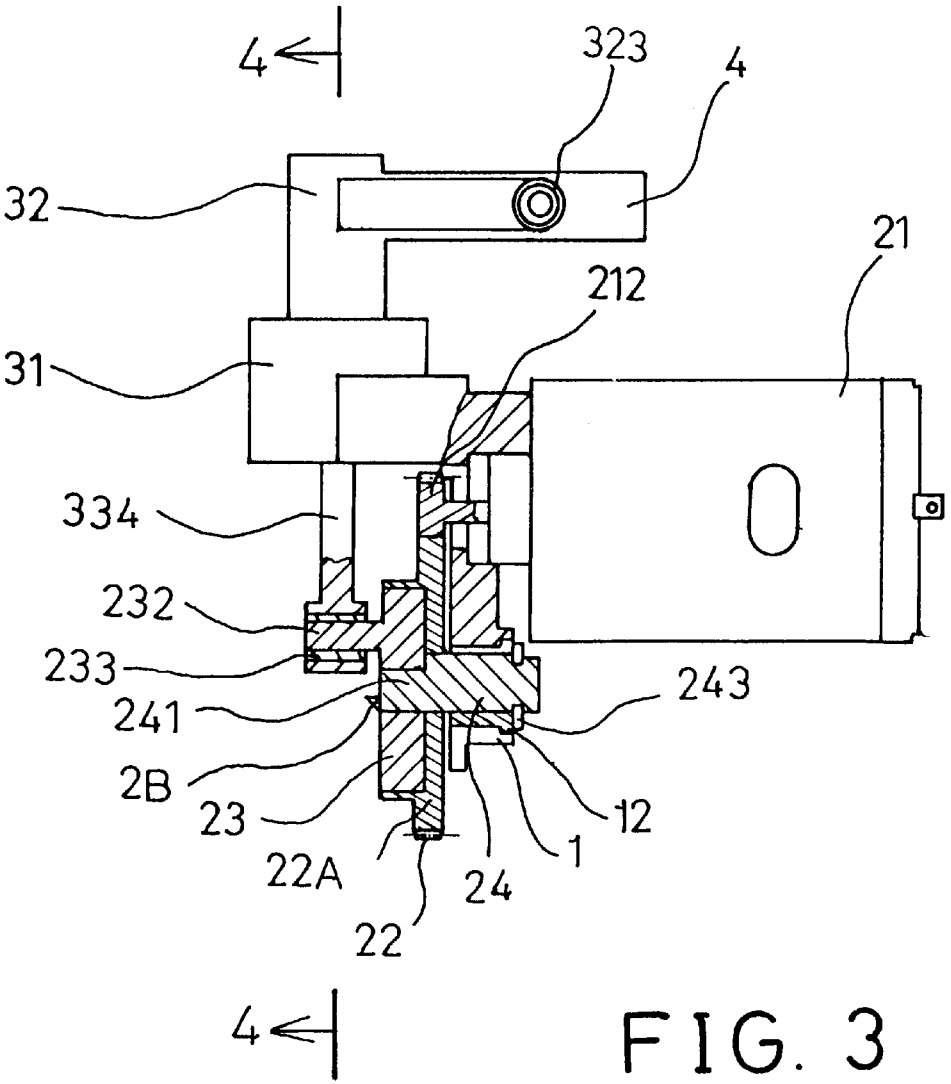
FIG. 3 is a partial cross sectional view taken along lines 3—3 of FIG. 2.

Referring to the drawings, and initially to FIGS. 1–4, an air compressor in accordance with the present invention comprises a base 1 including an opening 11 formed therein for receiving a pinion 211 of a motor 21 which is secured to the base 1 by fasteners 212, in which the fasteners 212 are engaged through the holes 13 of the base 1 and are threaded to the screw holes 213 of the motor 21 for securing the motor 21 to the base 1. The base 1 includes an aperture 10 formed therein for receiving a pivot shaft 24 which has one end 242 secured to the base 1 by a clamping ring 243 and which has the other end 241 extended outward of the base 1. As shown in FIG. 3, a bushing 12 is engaged in the aperture 10 of the base 1 and is engaged between the pivot shaft 24 and the base 1. A housing 31 is secured to the base 1 and includes a tube 32 extended upward therefrom, and a pipe 322 extended from the tube 32 and coupled to a nozzle or a hose via a coupler 323 for output the pressurized air generated by the compressor. An air gage or a pressure gage 4 is coupled to the pipe 322 for measuring the air pressure in the housing 31. The tube 32 includes a control valve, such as a check valve received therein for controlling the pressurized air to flow from the housing 31 to the coupler 323 only and for preventing the pressurized air to flow back into the housing 31.

A gear 22 includes a hole 220 formed therein for receiving the pivot shaft 24 and for rotatably securing to the base 1 at the pivot shaft 24 and includes a casing 2A provided therein for receiving and supporting a weight 23. The weight 23 includes a non-circular hole 231 formed therein for receiving and engaging onto a non-circular end 241 of the pivot shaft 24 such that the weight 23 and the gear 22 rotate in concert with the pivot shaft 24. The weight 23 includes a pin 232 spaced from the pivot shaft 24 or eccentric relative to the pivot shaft 24. The pin 232 may also be directly extended from the gear 22, instead of from the weight 23. The casing 2A includes one or more shoulders each having a stop 2B extended therefrom for engaging with and for retaining the weight 23 of different thicknesses in the casing 2A. The gear 22 includes one half having a number of teeth 22A of a greater thickness than the teeth 22B of the other half of the gear 22. The teeth 22A, 22B of the gear 22 are engaged with the pinion 211 of the motor 21. The engaging area between the pinion 211 and the teeth 22A is greater than that between the other teeth 22B and the pinion 211 such that the motor 21 may drive the gear 22 with a less power when the pinion 211 is engaged with the teeth 22B and such that the motor 21 may effectively drive and rotate the gear 22.

Figure 5:
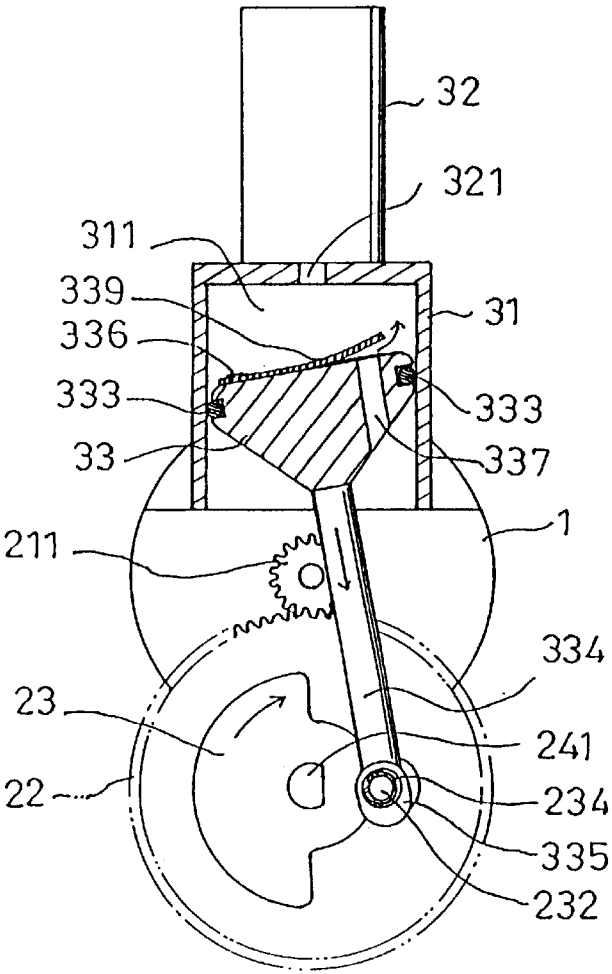
FIGS. 5, 6, 7 are partial cross sectional views similar to FIG. 4, illustrating the operation of the air compressor.
Figure 4:
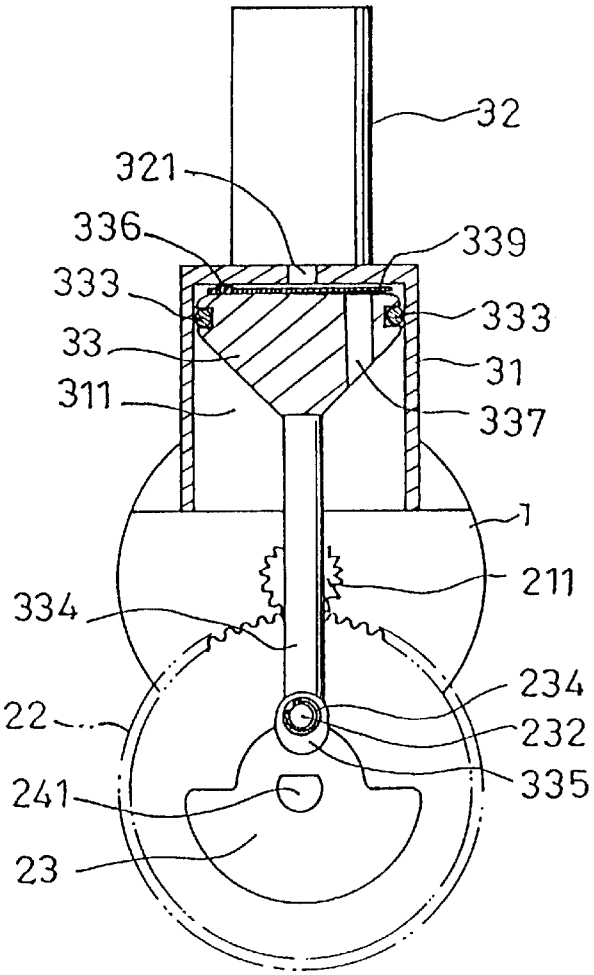
FIG. 4 is a partial cross sectional view taken along lines 4—4 of FIG. 3.

The housing 31 includes a chamber 311 (FIGS. 4–7) formed therein for slidably receiving a piston 33 which includes an annular groove 332 formed in the outer peripheral portion for receiving a sealing ring 333 that may make an air tight seal between the piston 33 and the housing 31. The piston 33 includes a rod 334 extended downward therefrom and having a ring 335 provided in the bottom portion thereof for rotatably securing to the pin 232 of the weight 23 by a bearing 233 and secured to the rod 334 by a clamping ring 234, such that the piston 33 may be moved up and down along the housing 31 in a reciprocating action by the motor 21 via the eccentric pin 232 of the gear 31. The piston 33 includes an upper surface 331 having a swelling or a latch 336 extended upward therefrom for engaging into a hole 37 of a spring blade 339 and for securing one end of the spring blade 339 to the piston 33. The piston 33 includes an aperture 337 formed therein for allowing the air to flow from outside of the housing 31 into the chamber 311 of the housing 31 (FIG. 5). The housing 31 includes a passage 321 formed therein (FIGS. 4–7) for communicating the chamber 311 of the housing 31 with the tube 32.

Figure 7:
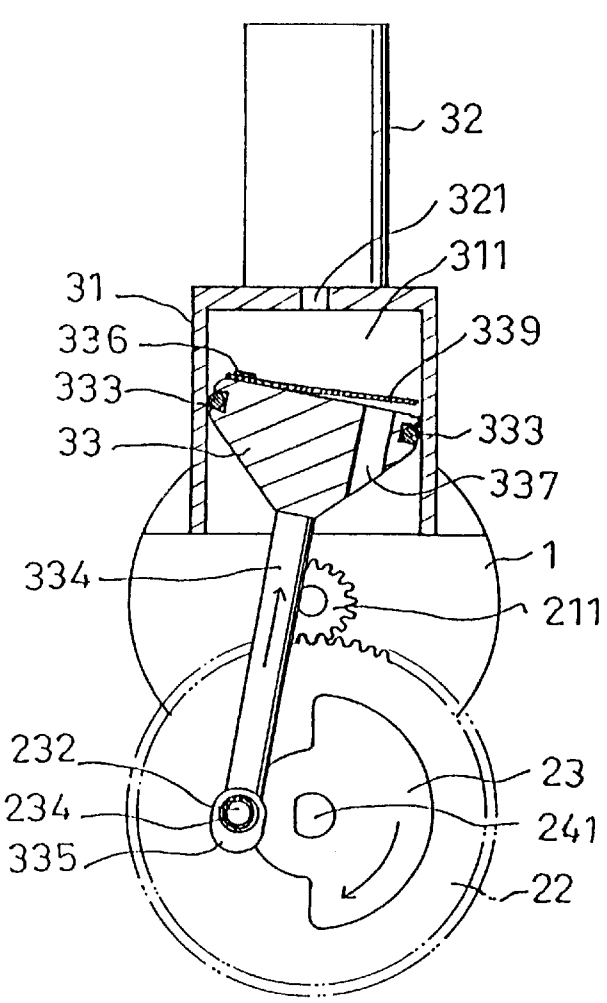
Figure 6:
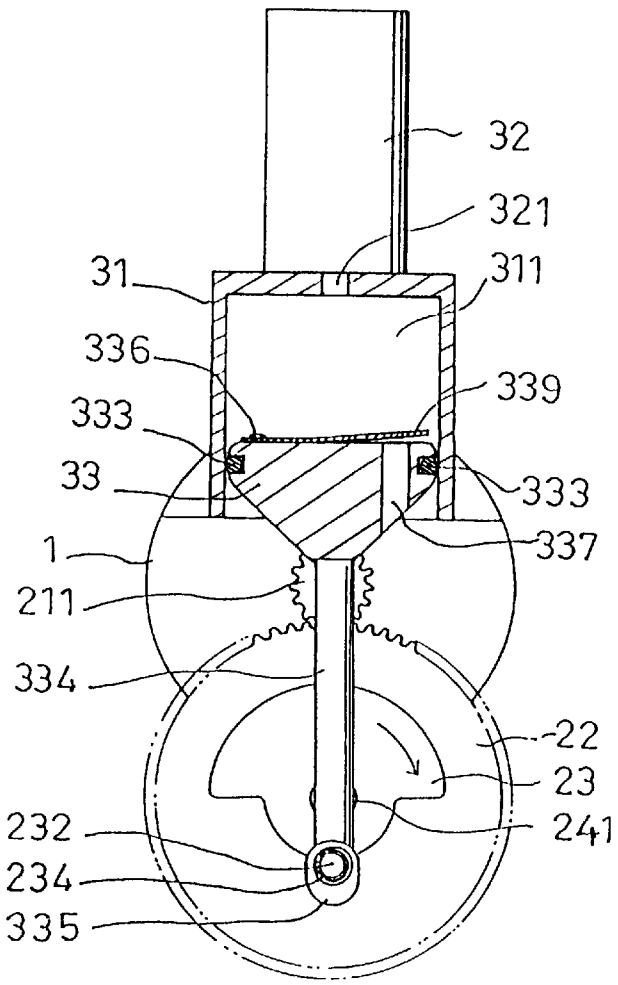

In operation, as shown in FIGS. 4–7, the piston 33 may be moved up and down along the chamber 311 of the housing 31 in a reciprocating action by the motor 21 via the eccentric pin 232 of the weight 23 of the gear 22. When the piston 33 is moved toward the tube 32, the spring blade 339 may block the aperture 337 of the piston 33 and may force the air in the chamber 311 of the housing 31 out of the tube 32 through the passage 321 (FIG. 7). When the piston 33 moves downward from the top position (FIG. 4 to FIG. 5), the passage 321 will be blocked by the check received in the tube 32 and the air may be drawn into the chamber 311 of the housing 31 via the aperture 337 against the spring blade 339, as shown in FIG. 5, and may thus be forced outward through the tube 32. The air may thus be effectively forced outward through the tube 32.

Accordingly, the air compressor in accordance with the present invention includes a simplified piston for allowing the piston to be easily manufactured and assembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor comprising:

a) a housing including a tube extended upward therefrom, and including a passage formed therein and communicating said housing with said tube, said housing including a chamber formed therein, said tube including a pipe extended outward therefrom, b) a pressure gage connected to said pipe, c) a piston slidably received in said chamber of said housing, said piston including an outer peripheral portion having an annular groove formed therein, said piston including a rod extended downward therefrom, said piston including an aperture formed therein for allowing air to flow into said housing via said aperture of said piston, d) means for resiliently blocking said aperture of said piston, said blocking means including a spring blade having a first end secured to said piston and having a second end resiliently blocking said aperture of said piston, e) a sealing ring received in said annular groove of said piston for making an air tight seal between said piston and said housing, f) a base secured to said housing, and g) means for forcing said piston to move along said chamber of said housing in a reciprocating action, said forcing means including:

i) a motor secured to said base and having a pinion provided thereon, ii) a gear rotatably secured to said base at a pivot shaft and engaged with said pinion and driven by said motor via said pinion, said gear including a first half having a plurality of first teeth and including a second half having a plurality of second teeth, said first teeth including a thickness greater than that of said second teeth, said gear including a casing provided thereon, and iii) a weight received in said casing and secured to said pivot shaft and rotated in concert with said gear, said weight including a pin extended therefrom and eccentric relative to said pivot shaft, said pin being coupled to said rod for coupling said piston to said weight and said gear.

* * * * *